United States Patent [19]

Traise

[11] 4,055,294

[45] Oct. 25, 1977

[54] COMBINED MAILER AND RETURN ENVELOPE ASSEMBLY

[76] Inventor: John E. Traise, 885 Onondaga St., Lewiston, N.Y. 14092

[21] Appl. No.: 639,826

[22] Filed: Dec. 11, 1975

[51] Int. Cl.[2] ..... B65D 27/10; B65D 27/06; B65D 27/34

[52] U.S. Cl. ..... 229/69; 229/73

[58] Field of Search ..... 229/73, 85, 69, 92.1, 229/92.3; 282/11.5 A, 25

[56] References Cited

U.S. PATENT DOCUMENTS

| | | | |
|---|---|---|---|
| 1,591,231 | 7/1926 | Otis | 282/25 |
| 1,985,592 | 12/1934 | Woodward | 229/70 |
| 2,277,596 | 3/1942 | Lichter | 283/56 |
| 2,840,295 | 6/1958 | Fromm | 229/73 X |
| 2,895,664 | 7/1959 | Cone | 229/73 |
| 2,987,327 | 6/1961 | Carmichael | 282/25 |
| 3,070,280 | 12/1962 | Richmond | 229/62 X |
| 3,306,632 | 2/1967 | Stahmer | 282/25 |
| 3,312,385 | 4/1967 | Amort | 229/73 |
| 3,339,827 | 9/1967 | Steidinger | 229/69 |
| 3,406,894 | 10/1968 | Settle | 229/70 |
| 3,419,286 | 12/1968 | Noonan et al. | 282/11.5 A |
| 3,428,237 | 2/1969 | Dowen | 229/69 |
| 3,507,519 | 4/1970 | McNabb | 229/73 X |
| 3,531,046 | 9/1970 | Corrigan | 229/72 |
| 3,652,007 | 3/1972 | MacDougall | 229/73 |
| 3,726,471 | 4/1973 | Kalb | 229/92.8 |
| 3,802,618 | 4/1974 | Wiessner | 229/73 |
| 3,866,822 | 2/1975 | Faltin et al. | 229/73 X |
| 3,900,159 | 8/1975 | Gendron | 229/69 |

FOREIGN PATENT DOCUMENTS

| | | | |
|---|---|---|---|
| 1,484,517 | 5/1967 | France | 229/69 |

*Primary Examiner*—Stephen P. Garbe

[57] ABSTRACT

A single web is folded twice upon itself to provide an outgoing mailer. The first fold is secured in place to define a return envelope having an envelope pocket and a sealable flap. The second fold is removably secured over the first fold and may be separable into two parts, one of which being a receipt stub. Also, a removable return stub is formed adjacent the return envelope.

3 Claims, 7 Drawing Figures

COMBINED MAILER AND RETURN ENVELOPE ASSEMBLY

BACKGROUND OF THE INVENTION

This invention relates generally to a combined mailer and return envelope assembly, and more particularly to such an assembly constructed of a single web having a return envelope pocket, a removable panel including a receipt stub and a removable return stub adjacent the envelope pocket.

Various two-way mailers having been heretofore devised as including a return envelope for the return by the addressee upon opening the mailer envelope. Most such constructions, however, are of separate plies secured together in some manner which inherently involves a complex assembly operation. Moreover, features such as a return section and a receipt stub are not readily possible for such construction because of the limitations which an assembly of separate plies possesses. U.S. Pat. No. 3,428,237 to Dowen is illustrative of such a prior art assembly. The combined message and reply envelope disclosed by this patent includes at least three individual sheets wherein the top and bottom sheets are substantially the same size while the intermediate sheet is much shorter. The intermediate and bottom sheets are secured together to form a return envelope pocket and the top sheet is removably secured thereover. Assembling such an envelope of separate sheets is, however, tedious and inefficient.

SUMMARY AND OBJECTS OF THE INVENTION

It is therefore an object of the present invention to provide a combined return mailer and envelope assembly constructed of a single web of twice folded over portions of substantially the same size and including a return envelope, with a return stub and a receipt stub which may likewise be included in the assembly.

In carrying out this objective the present assembly includes a return envelope pocket formed of adhesive securing together bottom and intermediate plies folded over one another with a return stub removable from the intermediate ply adjacent the envelope pocket. The top ply is folded over the intermediate ply annd is secured thereto such as by means of adhesive disposed outwardly of the envelope pocket and along the free end of the upper ply. Tear strips are provided in the plies and contain the adhesive securing means for the top ply so that, upon removal of the tear strips, the top ply is substantially released from the intermediate ply. This top ply also is separable into two parts, one of which is a receipt stub for the addressee. And, sealing material is provided on the return envelope for sealing a return envelope flap after a protective covering for the sealing material is removed.

Other objects, advantages and novel features of the invention will become more apparent from the following detailed description of the invention when taken in conjunction with the accompanying drawings.

DESCRIPTION OF THE PREFERRED EMBODIMENT

Figure 1:
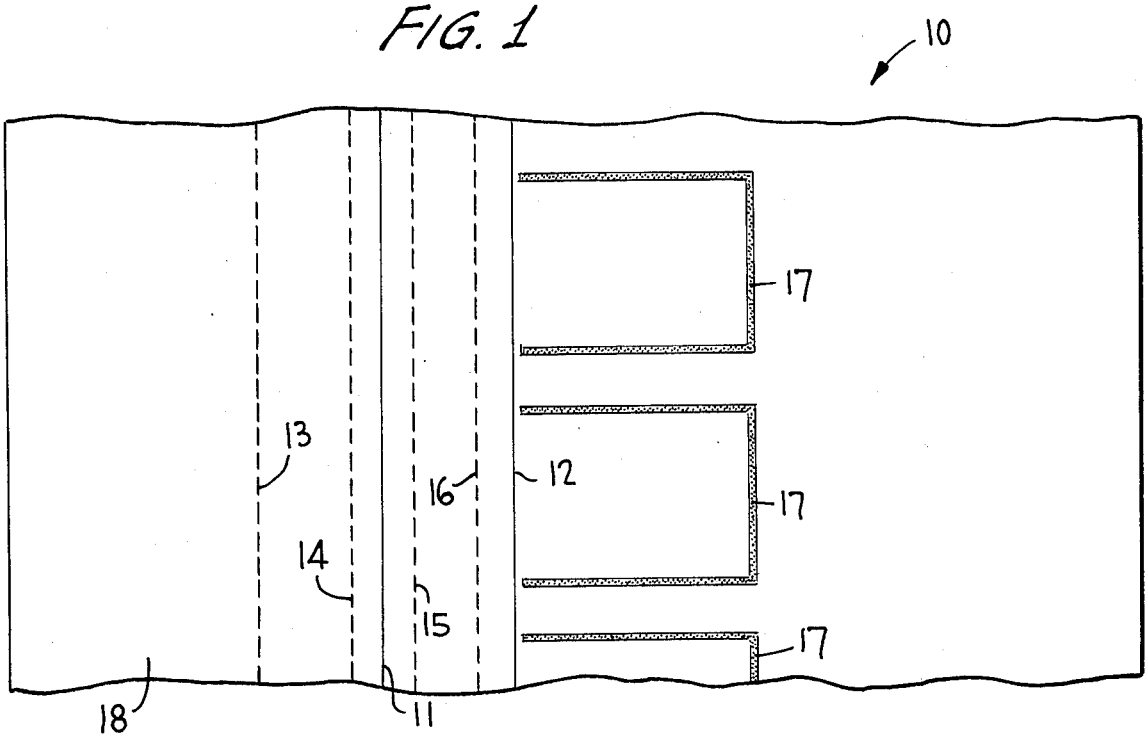
FIG. 1 is a top plan view of a continuous web of which the combined mailer and return envelope assembly of the invention is constructed.
Figure 4:
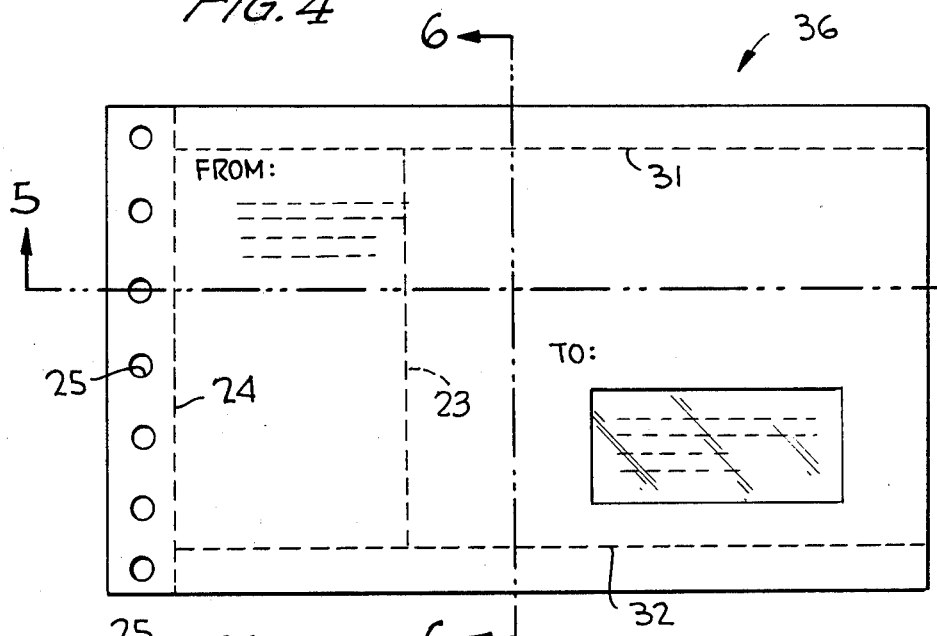
FIG. 4 is a top plan view of the assembly, slightly enlarged, after having been separated from the continuous web.
Figure 6:
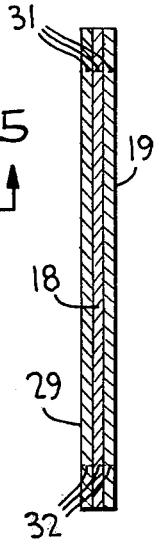
FIGS. 5 and 6 are respectively cross-sectional views of the FIG. 4 envelope assembly taken along lines 5—5 and 6—6 of FIG. 4.
Figure 5:
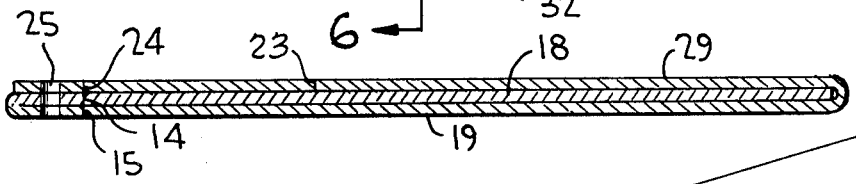

A continuous web 10 is shown in FIG. 1 from which series connected assemblies according to the invention are constructed. Score lines 11 and 12 are provided in the web as well as lines 13, 14, 15 and 16 of perforations. Pattern prints 17 which may be of cold flow adhesive are also applied on the web in U-shaped form substantially as shown in FIG. 1 and opening toward fold line 11. Web portion 18 constituting an intermediate ply or a first web portion as to be hereinafter described, is then plow folded along score line 11 so as to overlie a second web portion 19 which will ultimately constitute a bottom ply of the assembly as shown in FIG. 4. It should be noted that the above-mentioned plow folding operation is common in business forms manufacturing as a means for folding continuous webs as in the invention. Return envelope pockets 21 are thereby formed between web portions 18 and 19.

Figure 2:
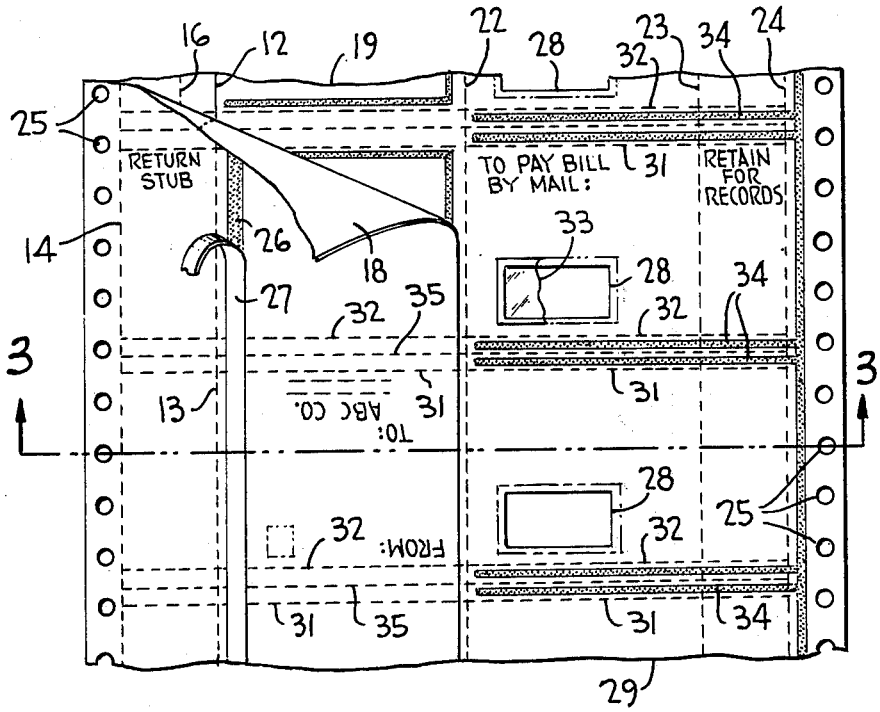
FIG. 2 is a plan view similar to FIG. 1 showing a portion of the continuous web being first folded on itself to form the return envelope of the assembly.

All press printing may now be carried out for applying information on those portions of the web typically shown in FIG. 2 as identifying return and record stubs, operation instructions for the addressee, and a printed face of the return envelopes.

Figure 3:
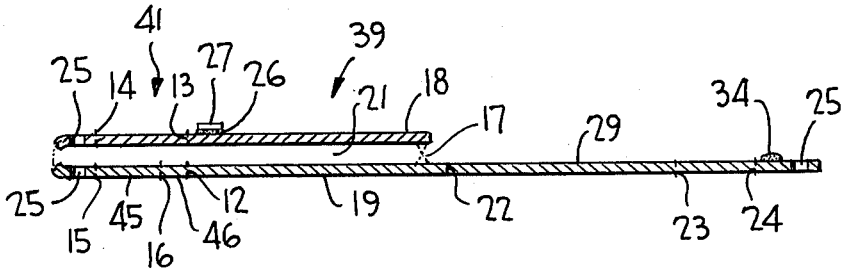
FIG. 3 is a cross-sectional view through the partly constructed assembly taken along line 3—3 of FIG. 2.

Lines 22, 23 and 24 of perforations parallel to the fold lines are then applied along the web, and marginal web feed holes 25 are provided along the left and right margins as shown in FIGS. 2 and 3 for processing the web during assembly and user processing over computer printers. A strip of sealing material 26 is applied along the top surface of web portion 18 inwardly of line 13 of perforations. And, a cover strip 27, typically of glassine or wax coated paper, is applied over the sealing material for effectively covering same until subsequently removed.

Windows 28 are then die-cut in third web portion 29 constituting a top ply upon folding, and transverse lines 31, 32 of perforations are applied in the partly folded over web just outwardly of the upper and lower leg portions of pattern print areas 17. Clear window patches 33 of any suitable material may then be secured over windows 28, and pattern prints 34, which may be of hot melt adhesive, are applied in U-shaped form on web portion 29 substantially as shown in FIG. 2. These adhesive pattern prints are disposed outwardly of lines 24, 31 and 32 of perforations, and they open toward line 22 of perforations. Transverse lines 35 of perforations are applied in the folded-over web between the adjacent legs of adhesive pattern prints 34 so as to define series connected envelope assemblies, ready for successive printing, folding, sealing, and detaching.

The top face of the open envelope assembly shown in FIG. 2 is then computer printed either on the printing press or by conventional billing methods to apply the necessary address information as shown in FIG. 2. Serially addressed forms are then processed into mail-ready configuration by folding panel 29 over previously folded panels 18 and 19, along perforation 22, then sealing by activating previously applied hot-melt adhesive 34 and bursting by equipment in general usage for this operation. Individually separated stacks of envelope assemblies are then ready for mail processing.

Figure 7:
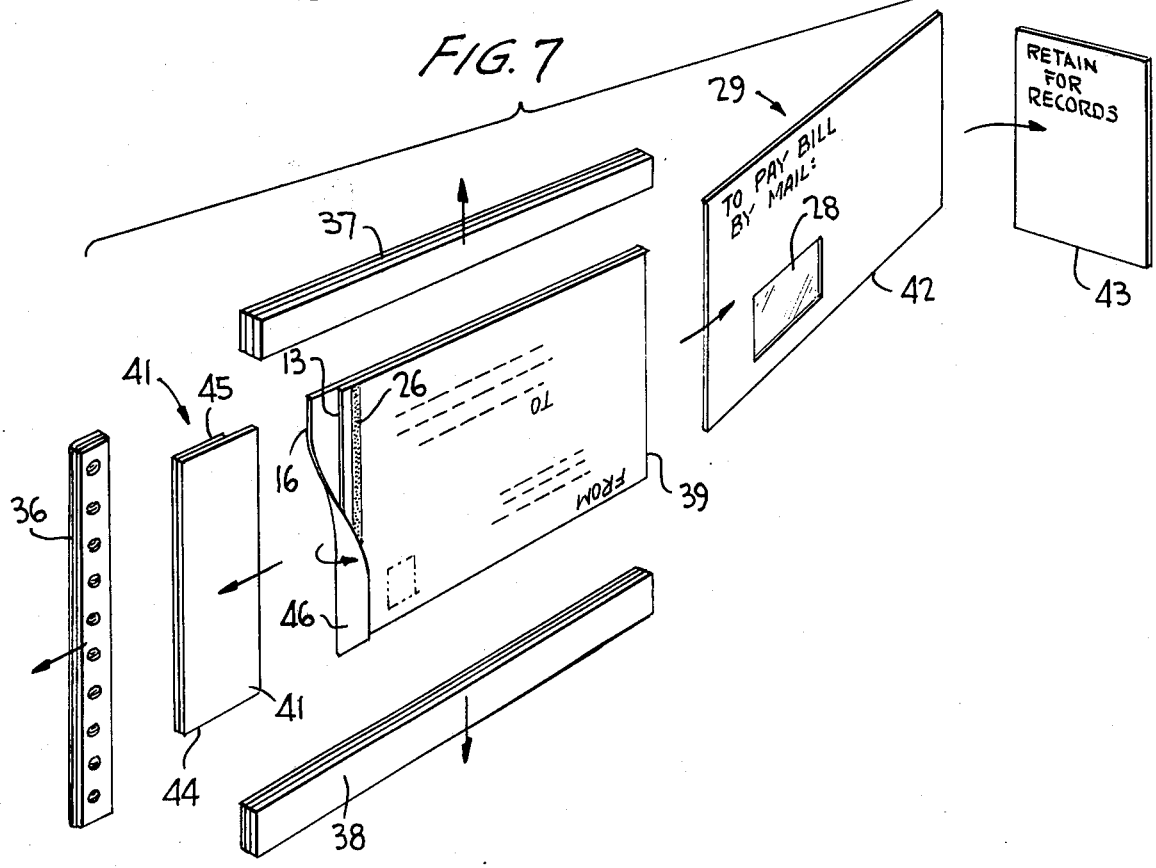
FIG. 7 is a top plan view similar to FIG. 4, although slightly reduced in size, of the envelope assembly in accordance with the invention after having been received by the addressee and showing the manner in which the envelope is opened.

Upon receipt, the addressee is instructed by indicia applied on the top face of the assembly 36 to carefully remove stubs 36, 37 and 38 as illustrated in FIG. 7 along their respective lines 24, 31 and 32 of perforations. Since these three stubs contain the three legs of adhesive pattern print 34, the means securing the third web portion or top ply 29 in place is removed. A return envelope 39 having a removably attached part 41 thereon remains after stub removal together with upper ply 29 removably secured to the return envelope along line 22 of weakening. The top ply may then be separated along line 22 and subsequently separated into two parts 42 and 43 along line 23 of perforations. In the configuration shown in FIG. 7, part 42 containing window 28 may then be discarded by the addressee, and part 43 may comprise a receipt stub for retention by the addressee, although individual layout preferences could be altered.

Upon removal of stubs 36, 37 and 38, the addressee is likewise instructed to remove part 41 from the return envelope along lines 13 and 16 of perforations. This part 41 actually comprises two superimposed first and second sections 44 and 45 (see also FIG. 3) wherein the former is defined between lines 13 and 14 of perforations and the latter is defined between lines 15 and 16 of perforations. Section 44 may therefore comprise a return stub for insertion into envelope pocket 21 of the return envelope. The addressee is then instructed to remove cover strip 27 so that return envelope flap 46, defined between score line 12 and line 16 of perforations in bottom ply 19, can be folded over the open end of, the return envelope for sealing the flap along material 26.

From the foregoing, it can be seen that a combined mailer and return envelope assembly constructed of a single web twice folded over on itself is provided in such a manner as to be easily assembled yet is highly economical as compared to multiple part constructions. The assembly includes a return envelope and a return stub for insertion therein as well as a record stub for retention by the addressee. The flap for the return envelope may be formed on the bottom ply as disclosed or on the intermediate ply if desired, and spots of adhesive may be used to secure the top ply in place in lieu of the top and bottom glue streams of adhesive pattern print 34. Accordingly, stubs 37 and 38 would not be needed since the top ply could be simply peeled away after the removal of stub 36.

Obviously, many other modifications and variations of the invention are made possible in the light of the above teachings. It is therefore to be understood that within the scope of the appended claims the invention may be practiced otherwise as specifically described.

What is claimed is:

1. A combined mailer and return envelope assembly, comprising a continuous web having spaced and parallel transverse lines of weakening therealong for separating said web into individual units, said web having first and second spaced and parallel longitudinal fold lines therein defining adjacent first, second and third web portions, said first and third portions respectively overlying said second and first portions upon being folded along said respective first and second fold lines, said first and second portions of each said unit being adhesively secured together by adhesive means defining a pocket of a return envelope opening toward said first fold line, said third portion of each said unit being removably secured to said first portion and having an end lying adjacent said first fold line, a detachable end stub in said overlying web portions and including said end of said third portion, said second portion of each said unit having a first section adjacent said stub and a flap detachably secured to said section, said first portion of each said unit having a second section detachably secured thereto and overlying said first section as well as said flap, whereby removal of said stub facilitates removal of said third portion and exposes said return envelope, and removal of said sections exposes said flap for closing said return envelope packet.

2. The assembly according to claim 1, wherein said first and third portions of each said unit are secured together by further adhesive means lying outwardly of said adhesive means parallel to said transverse lines and to said third portion end, detachable side stubs in said overlying web portions and containing said further adhesive means, whereby said third portion of each said unit is separable from said first portion upon removal of said stubs.

3. The assembly according to claim 1, wherein said third portion of each unit is separable into two parts along a line of weakening, one of said parts constituting a receipt stub of the assembly.

* * * * *

UNITED STATES PATENT OFFICE
CERTIFICATE OF CORRECTION

PATENT NO. : 4,055,294
DATED : OCTOBER 25, 1977
INVENTOR(S) : JOHN E. TRAISE

It is certified that error appears in the above-identified patent and that said Letters Patent are hereby corrected as shown below:

ON THE TITLE PAGE Insert:

-- Assignee: Moore Business Forms, Inc.
Niagara Falls, New York 14302 --

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*